US009025799B2

(12) United States Patent
Ozawa et al.

(10) Patent No.: US 9,025,799 B2
(45) Date of Patent: May 5, 2015

(54) SOUND REPRODUCING DEVICE

(75) Inventors: Noriyuki Ozawa, Tokyo (JP); Kazuhisa Kito, Kanagawa (JP); Kohei Asada, Kanagawa (JP); Naotaka Tsunoda, Tokyo (JP)

(73) Assignee: Sony Corporation, Tokyo (JP)

( * ) Notice: Subject to any disclaimer, the term of this patent is extended or adjusted under 35 U.S.C. 154(b) by 424 days.

(21) Appl. No.: 13/565,180

(22) Filed: Aug. 2, 2012

(65) Prior Publication Data

US 2013/0051562 A1 Feb. 28, 2013

(30) Foreign Application Priority Data

Aug. 31, 2011 (JP) ..... 2011-189553

(51) Int. Cl.
*H04R 5/02* (2006.01)
*H04R 5/00* (2006.01)

(52) U.S. Cl.
CPC ..... *H04R 5/00* (2013.01)

(58) Field of Classification Search
CPC ..... H04R 1/10; H04R 1/1083; H04R 1/1025; H04R 1/1033; H04R 2201/003; H04R 2201/107; H04R 5/04
USPC ..... 381/309, 74, 323, 71.1, 71.6, 317, 17
See application file for complete search history.

(56) References Cited

U.S. PATENT DOCUMENTS 8,385,560 B2 * 2/2013 Solbeck et al. ..... 381/71.8

FOREIGN PATENT DOCUMENTS

JP 2003-047083 A 2/2003

* cited by examiner

*Primary Examiner* — Paul S Kim
(74) *Attorney, Agent, or Firm* — Wolf, Greenfield & Sacks, P.C.

(57) ABSTRACT

A sound reproducing device includes: a plug section configured to receive input of L-channel and R-channel audio signals; an L-channel housing section including at least an L-channel driver unit configured to produce sound on the basis of the L-channel audio signal, an L-channel microphone configured to collect external sound, and an L-channel microcomputer configured to perform setting control on noise-canceling processing on the basis of a collected sound signal of the microphone; an R-channel housing section including a same corresponding configuration as those of the L-channel housing section; and an in-cord housing section formed so as to be inserted in a wiring cord for supplying the signals inputted from the plug section to the L-channel and the R-channel housing sections, wherein the in-cord housing section is provided with a communication terminal for allowing data communication between the L-channel microcomputer and the R-channel microcomputer, and an external apparatus.

2 Claims, 13 Drawing Sheets

SOUND REPRODUCING DEVICE

CROSS REFERENCE TO RELATED APPLICATIONS

This application claims priority to Japanese Priority Patent Application JP 2011-189553, filed in the Japan Patent Office on Aug. 31, 2011, the entire contents of which are hereby incorporated by reference.

BACKGROUND

The present technique relates to sound reproducing devices having a function of canceling noise.

A related technique has been disclosed in Japanese Unexamined Patent Application Publication No. 2003-47083.

Earphone devices having a function of canceling noise (in the following, also referred to as NC earphone devices) have been widespread in general.

NC earphone devices perform noise-canceling processing by the earphone devices themselves, and thus a user can enjoy noise-canceling effect when they use the earphone devices by connecting to a normal audio player.

FIG. 13 is an outer view of a related-art NC earphone device 100.

The NC earphone device 100 illustrated in FIG. 13 is a so-called insert earphone device.

Here, the insert earphone device is a generic term of an earphone device whose sound producing section is inserted into an earhole of a wearer for listening. For example, canal and inner-ear earphone devices fall under the category of the insert earphone device.

The NC earphone device 100 illustrated in FIG. 13 is a canal NC earphone device.

As illustrated in FIG. 13, The NC earphone device 100 has an Lch (ch: channel) output section 101L, an Rch output section 101R, a plug section 102, and an in-cord housing section 103.

As illustrated in FIG. 13, the plug section 102 and the in-cord housing section 103 are connected by a cord, and the in-cord housing section 103, and the Lch output section 101L and Rch output section 101R are connected by cords, respectively.

The Lch output section 101L and the Rch output section 101R are provided with a driver unit, which produces sound in accordance with an audio signal inputted through the plug section 102, and a microphone for collecting external sound in order to achieve a noise-canceling function individually.

An electric circuit section (noise-canceling processing section) is disposed in the inside of the in-cord housing section 103 in order to achieve a noise-canceling function.

The noise-canceling processing section generates an Lch-side noise-canceling signal on the basis of an Lch audio signal inputted from the plug section 102 and a collected sound signal from the microphone in the Lch output section 101L. In the same manner, the noise-canceling processing section generates an Rch-side noise-canceling signal on the basis of the Rch audio signal inputted from the plug section 102 and a collected sound signal from a microphone in the Rch output section 101R. And the noise-canceling processing section drives a driver unit in the Lch output section 101L on the basis of the Lch-side noise-canceling signal, and drives a driver unit in the Rch output section 101R on the basis of the Rch-side noise-canceling signal. Thereby, a wearer of the NC earphone device 100 is allowed to perceive sound whose noise has been canceled.

Also, a battery box 103A for accommodating a battery for supplying power necessary for the above-described noise-canceling processing is formed in the in-cord housing section 103.

Incidentally, an NC earphone device 100 is subjected to a sound check at predetermined timing, such as at the time of factory shipment in order to absorb variations for individual devices, and is subjected to adjustment of setting values in the noise-canceling processing in accordance with a result of the check.

Specifically, sound playback is performed in a state of setting the Lch output section 101L and the Rch output section 101R in a predetermined adjustment tool, and setting values of the noise-canceling processing in accordance with the individual devices are obtained from results of analyzing the output sound. The setting values obtained in this manner are instructed to the NC earphone device 100 to set the values.

At this time, in order to give an instruction input of the setting values, the in-cord housing section 103 is provided with a communication terminal for inputting the setting values in advance, and then the instruction input is carried out through the communication terminal. Such a communication terminal is exposed to the outside by breaking away a part of the in-cord housing section 103, etc., and the communication terminal is not assumed to be used by a user (end user).

SUMMARY

Here, as is understood from the above description, in the related-art NC earphone device 100, an electric circuit for performing the noise-canceling processing and various kinds of setting control is formed in the in-cord housing section 103. Specifically, a microcomputer that performs the noise-canceling processing, etc., is mounted.

Since such a microcomputer is mounted, a battery box 103A for accommodating a battery that supplies power to the microcomputer is formed in the in-cord housing section 103. From these points, in the related-art NC earphone device 100, the in-cord housing section 103 becomes large in size and heavy.

When the in-cord housing section 103 becomes heavy, the Lch output section 101L and the Rch output section 101R that are worn by a user are apt to be pulled downward, and there has been a problem in that a sense of good fitting is lost as a result.

In this regard, in order to take measures against this, a clip, etc., has sometimes been disposed at some place, such as an edge of a chest pocket, etc., so far in order to engage and fasten the in-cord housing section 103, and to prevent the output section 101 from being pulled by the weight of the in-cord housing section 103 so as to improve stability of the sense of fitting. However, with this configuration, there has been a problem in that it is necessary to form a clip originally, and for the user to take time to attach the clip.

Thus, it is thought that a configuration is employed in which a microcomputer for the noise-canceling processing and a battery are accommodated in the housings of the Lch output section 101L and the Rch output section. Thereby, it is possible to drastically reduce the size and the weight of the in-cord housing section 103, and thus to solve the above-described problem.

However, if a configuration in which noise-canceling microcomputers are mounted on the output sections 101L and 101R is employed, the following problem arises.

That is to say, to date, a configuration in which a communication terminal to be used at the time of a sound check is disposed on the housing section in which a microcomputer is mounted has been employed. In the case of mounting noise-canceling microcomputers in the output sections 101L and 101R, if a configuration like this is employed, it becomes necessary to break away a part of the housings of the output sections 101L and 101R in order to expose communication terminals at the time of a sound check.

In this manner, if parts of the output sections 101L and 101R are broken away, sound characteristics become different from those at the time of actual use, and it becomes difficult to obtain correct setting values at adjustment processing as a result. That is to say, it becomes difficult to correctly adjust the setting values of the noise-canceling processing.

According to an embodiment of the present disclosure, there is provided a sound reproducing device including a plug section configured to receive input of an L-channel audio signal and an R-channel audio signal.

Also, the sound reproducing device includes an L-channel housing section including at least an L-channel driver unit configured to produce L-channel sound on the basis of the L-channel audio signal, an L-channel microphone configured to collect external sound, and an L-channel microcomputer configured to perform setting control on noise-canceling processing on the basis of a collected sound signal of the L-channel microphone.

Also, the sound reproducing device includes an R-channel housing section including at least an R-channel driver unit configured to produce R-channel sound on the basis of the R-channel audio signal, an R-channel microphone configured to collect external sound, and an R-channel microcomputer configured to perform setting control on noise-canceling processing on the basis of a collected sound signal of the R-channel microphone.

Also, the sound reproducing device includes an in-cord housing section formed so as to be inserted in a wiring cord for supplying the signals inputted from the plug section to the L-channel housing section and the R-channel housing section.

And the in-cord housing section is provided with a communication terminal for allowing data communication between the L-channel microcomputer and the R-channel microcomputer, and an external apparatus.

As described above, in the present technique, a configuration is employed in which a noise-canceling processing microcomputer is accommodated in a housing of the sound output section that includes a driver unit for performing sound output (sound reproduction). And with such a configuration, the in-cord housing section is provided with a communication terminal for performing data communication with the above-described microcomputer.

With this configuration, it becomes unnecessary to break away a part of the housing of the sound output section in order to expose a communication terminal at the time of a sound check, and thus it is possible to perform a sound check in the same state as that at the time of actual use. As a result, it is possible to suitably adjust the setting values of the noise-canceling processing.

As described above, by the present technique, it is possible to provide a sound reproducing device capable of suitably adjusting the setting values of the noise-canceling processing.

DETAILED DESCRIPTION OF EMBODIMENT

Figure 1:
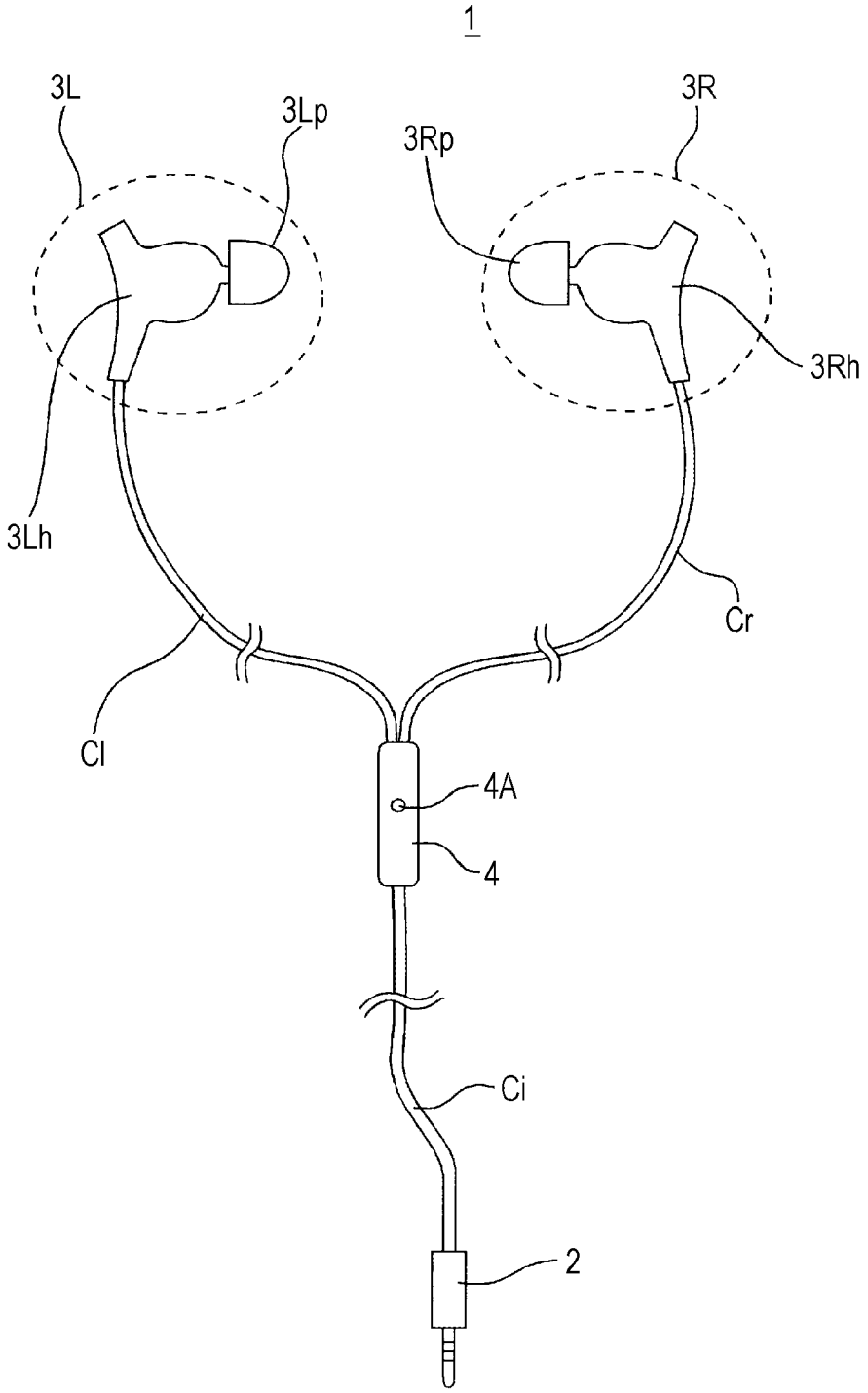
FIG. 1 is an outer view of an NC earphone device according to an embodiment.

In the following, a description will be given of an embodiment according to the present technique.

In this regard, the description will be given in the following order.

1. Device structure as embodiment
2. Device internal configuration as embodiment
3. About communication with external apparatus
4. Various functions
5. Processing procedure
6. Summary
7. Variations 1. Device Structure as Embodiment FIG. 1 an outer view of an NC earphone device 1 (NC: Noise Canceling) according to an embodiment of the present technique.

Here, the NC earphone device means an earphone device having a NC function. The NC earphone device performs noise-canceling processing by the earphone device itself, and thus a user can enjoy noise-canceling effect when they use the earphone device by connecting to a normal audio player.

The NC earphone device 1 according to the present embodiment is a so-called insert earphone device. The insert earphone device is a generic term of an earphone device whose sound producing section is inserted into an earhole of a wearer for listening. For example, canal and inner-ear earphone devices fall under the category of the insert earphone device.

The NC earphone device 1 illustrated in FIG. 1 is a canal earphone device.

As illustrated in FIG. 1, the NC earphone device 1 includes a plug section 2, an Lch (ch: channel) output section 3L, an Rch output section 3R, and an in-cord housing section 4. Also, the NC earphone device 1 includes an input-side cord Ci connecting the plug section 2 and the in-cord housing section 4, an Lch-side cord Cl connecting the in-cord housing section 4 and the Lch output section 3L, and an Rch-side cord Cr connecting the in-cord housing section 4 and the Rch output section 3R.

The plug section 2 is provided in order to input an output audio signal from an audio player to which the NC earphone device 1 is connected. The plug section 2 in this embodiment is provided with three terminals, Lch, Rch, and GND (ground), and thus three wiring lines corresponding to each of the terminals Lch, Rch, and GND are formed in the input-side cord Ci.

The Lch output section 3L is a member for outputting sound on the basis of an Lch signal (audio signal) inputted through the plug section 2. Also, in the same manner, the Rch output section 3R is a member for outputting sound on the basis of an Rch signal inputted through the plug section 2.

The Lch output section 3L includes a housing 3Lh as a casing, and an earpiece 3Lp detachably attached thereto. In the same manner, the Rch output section 3R includes a housing 3Rh as a casing, and an earpiece 3Rp detachably attached thereto.

The earpiece 3Lp of the Lch output section 3L and the earpiece 3Rp of the Rch output section 3R are inserted into corresponding ear holes of the user, respectively, and the user listens to output sound in that state.

Here, in order to achieve a noise-canceling function, collecting external sound (external noise sound) is requested. Accordingly, the Lch output section 3L and the Rch output section 3R are provided with microphones (microphones 11*l* and 11*r* described later) for collecting external sound, respectively.

In this embodiment, the in-cord housing section 4 is provided as an operation section enabling on/off (power on/off of the NC earphone device 1) operation of the noise-canceling function.

Specifically, as illustrated in FIG. 1, the in-cord housing section 4 is provided with an operation button 4A, and the user is allowed to give an on/off instruction to the NC earphone device 1 through the operation button 4A. In this embodiment, pressing the operation button 4A gives the on/off instruction. Pressing the operation button 4A in an off state gives an on instruction, and pressing the operation button 4A in an on state gives an off instruction.

Also, in this embodiment, a wiring line branches into an Lch side and an Rch side at the in-cord housing section 4.

Specifically, in the in-cord housing section 4, wiring lines of the Lch, the Rch, and GND included in the input-side cord Ci are divided into a group of an Lch.GND, and a group of an Rch.GND. The former group reaches the Lch output section 3L through the Lch-side cord Cl, and the latter reaches the Rch output section 3R through the Rch-side Cr.

In this regard, a description will be given later of details on the wiring lines included in the Lch-side cord Cl and the Rch-side cord Cr.

Next, a description will be given of structures in the housings of the Lch output section 3L and the Rch output section 3R according to the present embodiment with reference to FIG. 2 and FIGS. 3A, 3B and 3C.

Figure 2:
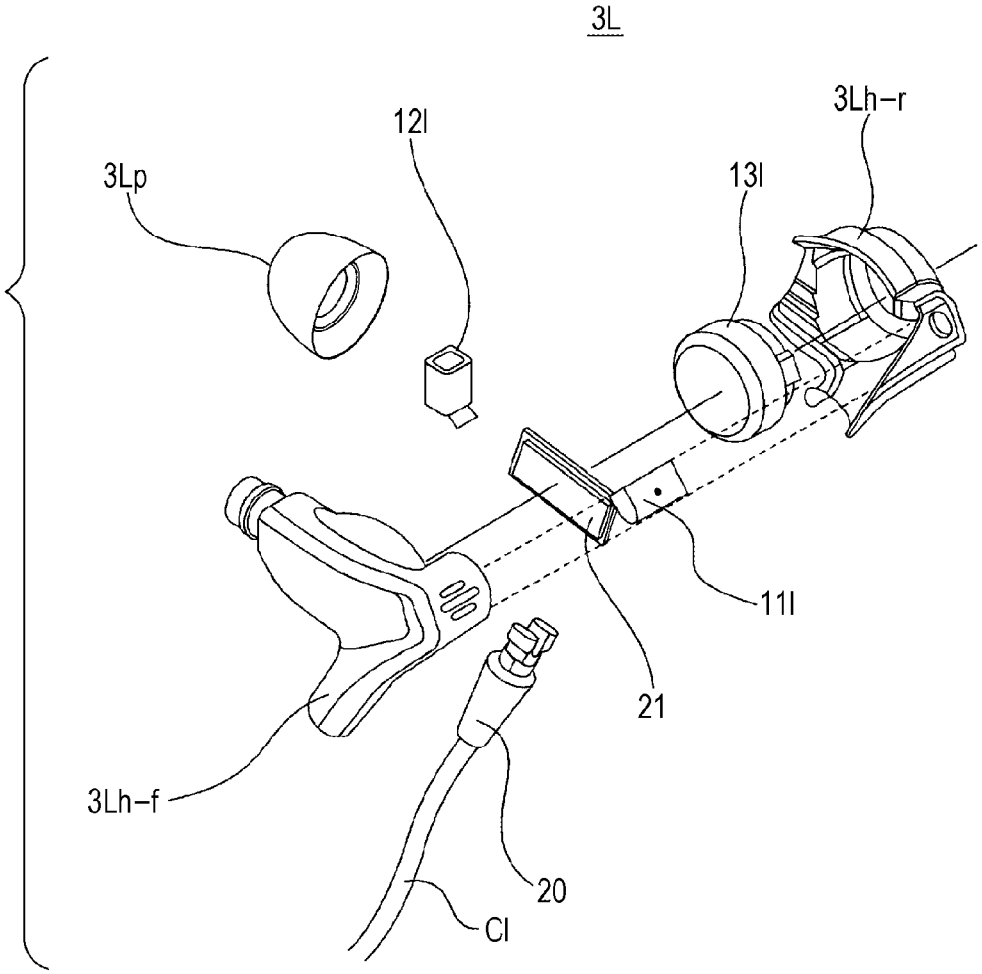
FIG. 2 is an exploded perspective view of an Lch output section according to the embodiment.

FIG. 2 illustrates an exploded perspective view of the Lch output section 3L.

Here, the structure of the Rch output section 3R is a structure obtained by horizontally reversing the structure of the Lch output section 3L (However, there is a difference in that the Rch output section 3R is provided an LED 15), and thus a description with reference to the figures is omitted.

In FIG. 2, the Lch-side cord Cl is also illustrated together with the Lch output section 3L. In this regard, the LED 15 (refer to FIG. 4) disposed on the Rch output section 3R functions as an indicator indicating the on/off state and the remaining amount of the battery of the NC earphone device 1.

As illustrated in FIG. 2, the Lch output section 3L included a housing front piece 3Lh-f constituting the housing 3Lh illustrated in FIG. 1, a housing rear piece 3Lh-r, an earpiece 3Lp similarly illustrated in FIG. 1, and a sleeve 20 for leading a wiring line in the Lch-side cord Cl into the inside of the housing 3Lh.

And, in the Lch output section 3L according to the present embodiment, a microphone 11*l*, a driver unit 12*l*, a circuit substrate 21, and a battery 13*l* are accommodated in the internal space of the housing 3Lh formed by the housing front piece 3Lh-f and the housing rear piece 3Lh-r.

The microphone 11*l* is disposed in order to collect external sound. In the case of a canal type, a so-called FF method (feed-forward method) is employed as a method of noise canceling, and the microphone 11*l* is disposed so that a sound collecting surface thereof faces in the opposite direction of the sound producing direction to the driver unit 12*l* in order to collect outside sound of the housing. In this embodiment, the microphone 11*l* is a MEMS (Micro Electro Mechanical Systems) microphone.

The circuit substrate 21 is a substrate on which an electric circuit section for achieving the noise-canceling function and various functions described later is formed. The Lch-side microcomputer 10*l* described later (the Rch-side microcomputer 10*r* in the Rch output section 3R) is formed on the circuit substrate 21.

The battery 13*l* is disposed as an operating power source of the electric circuit section formed on the circuit substrate 21. In the case of the present embodiment, a button-type secondary battery is employed.

The driver unit 12*l* produces sound (reproduces sound) on the basis of the audio signal. In the case of the present embodiment, a BA (BA: Balanced Armature) type is used as a driver unit 12*l*.

In this regard, in this embodiment, a hole section of the earpiece 3Lp is fitted against a cylindrical section formed on the housing front piece 3Lh-f (having a sound producing opening at the end) so that the earpiece 3Lp is attached to the housing 3Lh.

Figure 3A:
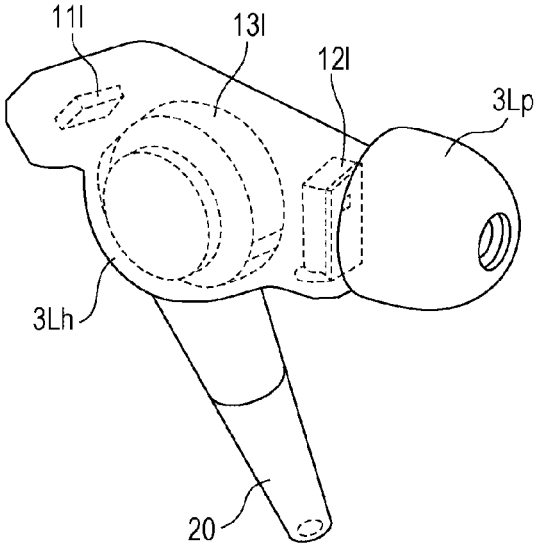
FIGS. 3A, 3B and 3C are diagrams illustrating a positional relationship between a microphone, a driver unit, and a battery that are accommodated in a housing.
Figure 3B:
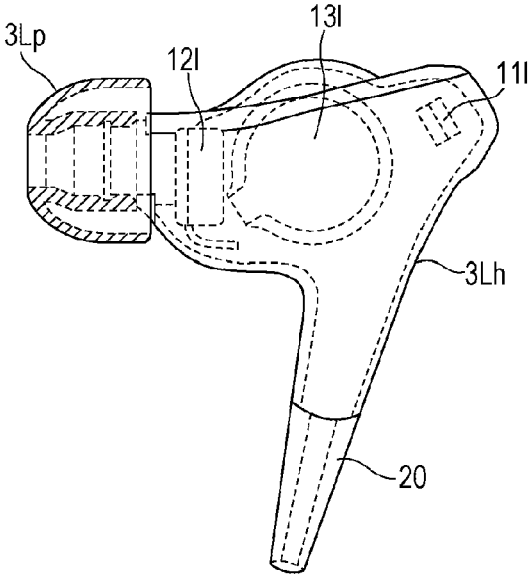
Figure 3C:
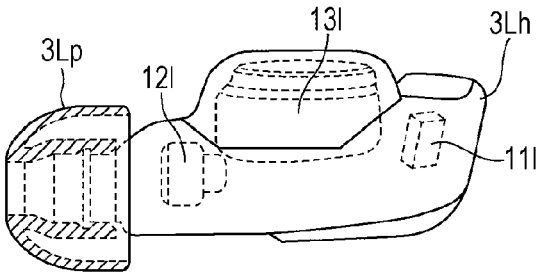

For confirmation, FIGS. 3A, 3B and 3C illustrate a positional relationship of the microphone 11*l*, the driver unit 12*l*, and the battery 13*l* that are accommodated in the housing 3Lh. FIG. 3A, FIG. 3B, and FIG. 3C are perspective views of the Lch output section 3L, and are a perspective view, a front view, and a top view, respectively.

Here, as is understood with reference to FIG. 2 and FIGS. 3A, 3B and 3C, in this embodiment, the housing 3Lh is designed so that a substantially cylindrical space is formed in addition to the space in which the driver unit 12*l* is accommodated. And the housing 3Lh is designed so that the circuit substrate 21 and the button-type battery 13*l* are accommodated in the substantially cylindrical space.

With such a design, in an earphone device that is requested to have a housing of the sound output section in a relatively small size as an insert earphone device, it is possible to efficiently accommodate the battery 13*l*, etc., in the housing 3Lh.

Also, in this embodiment, the MEMS microphone is used as the microphone 11*l*. The MEMS microphone is small in size, and thus it is possible to increase easiness of design in order to accommodate the battery 13*l*, etc., in the housing 3Lh. Alternatively, it is possible to increase degree of freedom in design.

Also, in this embodiment, a BA type is used as the driver unit 12*l*. The BA-type driver unit is relatively small in size compared with a dynamic type, etc., and in this point, it becomes easy to design the housing 3Lh for accommodating the battery 13*l*, etc., or to increase degree of freedom in design.

Here, by the above-described NC earphone device 1, the battery 13 that is necessary for achieving the noise-canceling function is accommodated in both of the Lch/Rch housings, and thus it is not necessary to dispose the battery box 103A on the in-cord housing section 103 as in the case of the related-art NC earphone device 100. Thereby, it is possible to drastically reduce the in-cord housing section 4 in size and weight, and thus it is possible to solve the problem in that a sense of good fitting of the Lch/Rch sound output sections is lost because of the weight of the in-cord housing section 4.

Also, the NC earphone device 1 according to the present embodiment has a left-right symmetrical structure between the Lch and the Rch sound output sections (excluding the LED 15). As a result, it is possible to achieve an earphone device having a good left and right weight balance, and an excellent sense of fitting.

Also, with the left-right symmetrical structure, free spaces in the Lch/Rch housings become the same, and thus acoustic characteristics become the same between the left and the right. Accordingly, it is possible to achieve natural listening comfort as a result.

In this regard, for confirmation, the LED 15 is very small in size and light in weight, and thus presence or absence thereof gives very small difference in the weight and acoustic characteristics.

Also, for a configuration in which the accommodation position of the battery 13 is designed apart from the in-cord housing section 4, it is thought that battery 13 is moved to any one of the Lch/Rch housings. However, if such a one-sided channel configuration is employed, it becomes necessary to design the housing sections separately between the left and the right. In contrast, by the present embodiment having the left-right symmetrical structure, the Lch and the Rch sound output sections are designed by designing for only one of the channels, and the other of the channels ought to be designed by reversing the one. On this point, it is possible to drastically increase easiness of the design.

Also, by employing a configuration that is distributed on the left and the right without using a one-sided channel configuration, it is possible to make the sizes of the sound output sections equal between the left and the right.

2. Device Internal Configuration as Embodiment

Figure 4:
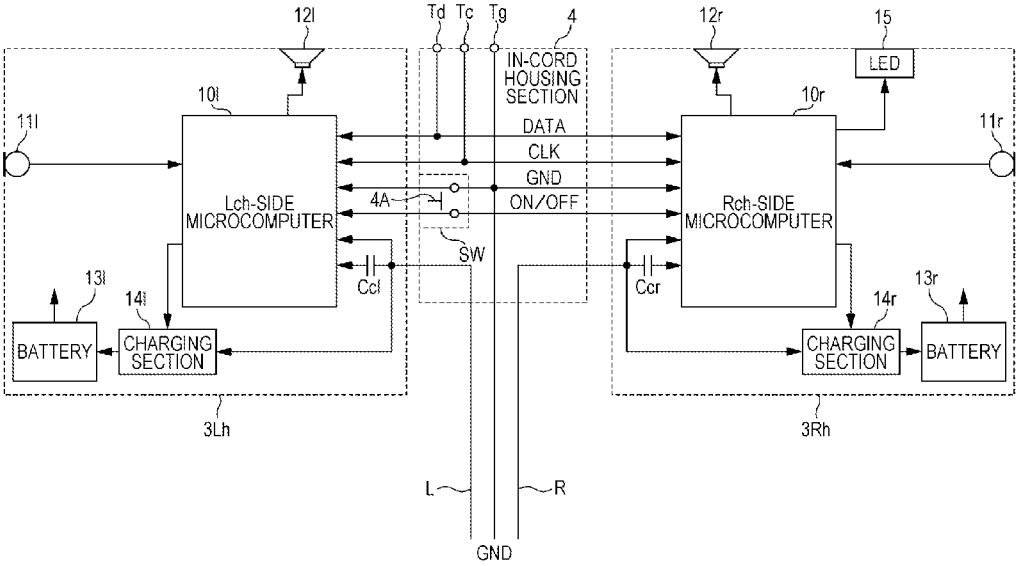
FIG. 4 is a block diagram illustrating an internal configuration of the NC earphone device according to the embodiment.

FIG. 4 is a block diagram illustrating an internal configuration of the NC earphone device 1.

In this regard, in FIG. 4, illustrations of the individual terminals (Lch, Rch, GND) formed on the plug section 2 are omitted.

First, the Lch signal and the Rch signal that are inputted through the plug section 2 are inputted into the housing 3Lh and the housing 3Rh through the in-cord housing section 4, respectively. In the housing 3Lh, the Lch signal is supplied to the Lch-side microcomputer 10*l* and the charging section 14*l*. In this embodiment, two systems including a signal that is through a capacitor Ccl and a signal that is not through the capacitor Ccl are inputted into the Lch-side microcomputer 10*l* as the Lch signal.

In the same manner, in the housing 3Rh, the Rch signal is supplied to the Rch-side microcomputer 10*r* and the charging section 14*r*. And two systems including a signal that is through a capacitor Ccr and a signal that is not through the capacitor Ccr are inputted into the Rch-side microcomputer 10*r* as the Rch signal.

The capacitors Ccl and Ccr are provided in order to cut a direct current component.

The Lch signal through the capacitor Ccl, and the Rch signal through the capacitor Ccr are used for the noise-canceling processing by the microcomputers 10, respectively (alternatively, for driving the driver unit 12 when the NC function is off).

Here, in this embodiment, the reason why a signal that is not through the capacitor Cc (a signal without cutting a direct current) is inputted into each of the microcomputers 10 is that charging the battery 13 is assumed to be carried out through the Lch and Rch wiring lines in this embodiment.

In this case, the direct current is supplied through the Lch and Rch wiring lines at the time of charging. Each of the microcomputers 10 monitors a signal of the wiring line that is not through the capacitor Cc, and determines whether or not the direct current is supplied. And if the direct current is supplied, each of the microcomputers 10 gives an instruction to the charging section 14 to charge the battery 13 (a charging control section Fn4 described later).

In this regard, as is apparent from FIG. 4, the charging section 14*l* supplies the direct current supplied through the Lch wiring line connected to the charging section 14*l* to the battery 13*l* for charging. In the same manner, the charging section 14*r* supplies the direct current supplied through the Rch wiring line connected to the charging section 14*r* to the battery 13*r* for charging.

Figure 7:
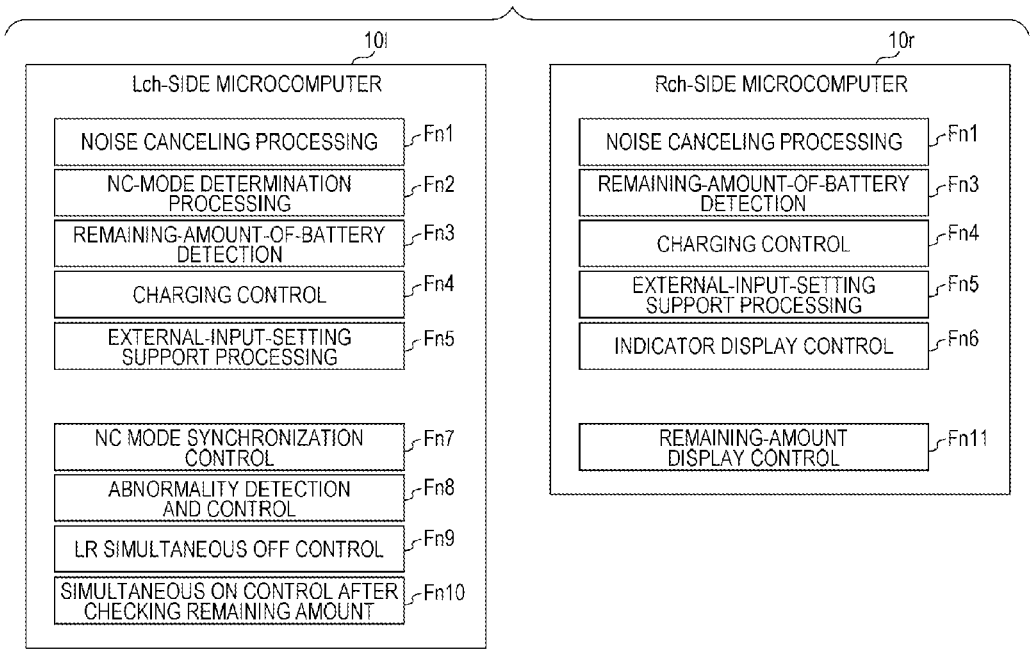
FIG. 7 is a diagram for explaining various functions that are possessed by an Lch-side microcomputer and an Rch-side microcomputer, respectively.

Each of the microcomputers 10 performs processing as each of function sections individually described later Fn (FIG. 7). For example, each of the microcomputers 10 performs processing for achieving the noise canceling function (a noise-canceling processing function section Fn1 described later).

Specifically, the Lch-side microcomputer 10*l* generates a noise-canceling signal for causing the user to perceive the external sound (noise sound) being canceled on the basis of the Lch signal inputted through the capacitor Ccl and the collected sound signal by the microphone 11*l*, and drives the driver unit 12*l* on the basis of the noise-canceling signal.

Thereby, it is possible to allow a wearer of the NC earphone device 1 to listen to Lch sound from which the external sound is canceled. That is to say, it is possible to obtain noise-canceling effect.

In this regard, the noise-canceling processing by the Rch-side microcomputer 10*r* is produced by reversing a symbol of L/R in the Lch-side processing, and thus a duplicated description is omitted.

Also, in this embodiment, the LED 15 is provided in the Rch-side housing section 3Rh, and the Rch-side microcomputer 10*r* correspondingly performs light emission drive control of the LED 15 (an indicator-display control function section Fn6 described later).

Also, in this embodiment, the Lch-side microcomputer 10*l* and the Rch-side microcomputer 10*r* are configured to be capable of performing data communication with each other. Specifically, in this embodiment, the Lch-side microcomputer 10*l* and the Rch-side microcomputer 10*r* are connected in a wired manner, thereby allowing data communication.

In this case, as a method of data communication, a serial communication method by I2C (Inter-Integrated Circuit) is employed, and thus the Lch-side microcomputer 10*l* and the Rch-side microcomputer 10*r* are connected by individual wiring lines of data (DATA), clock (CLK), and ground (GND).

As illustrated in FIG. 4, the individual wiring lines of data, clock, and ground connect the Lch-side microcomputer 10*l* and the Rch-side microcomputer 10*r* through in-cord housing section 4. That is to say, as is understood from this, the above-described Lch-side cord Cl and Rch-side cord Cr include the individual wiring lines of data, clock, and ground. In this regard, in this embodiment, the ground line is shared with the ground line for the audio signal.

The in-cord housing section 4 is provided with a switch SW that works with the above-described operation button 4A. The switch SW notifies presence of absence of pressing on the operation button 4A to the microcomputer 10. Specifically, in this embodiment, an on/off control line (ON/OFF) extending from the switch SW is connected to each of the microcomputers 10, and the switch SW connects the on/off control line and the ground line by the pressing on the operation button 4A.

In this regard, the above-described on/off control lines are connected to the Lch-side microcomputer 10*l* and the Rch-side microcomputer 10*r* through the Lch-side cord Cl and the Rch-side cord Cr, respectively.

3. About Communication with External Apparatus

Here, normally an NC earphone device is subjected to a sound check at a predetermined timing, such as at the time of factory shipment, etc., in order to absorb variations of individual devices, and the setting values of the noise-canceling processing are adjusted in accordance with the results.

In the NC earphone device 1 according to the present embodiment, the in-cord housing section 4 is provided with a communication terminal that allows input of such setting values, etc., from the outside.

Figure 5A:
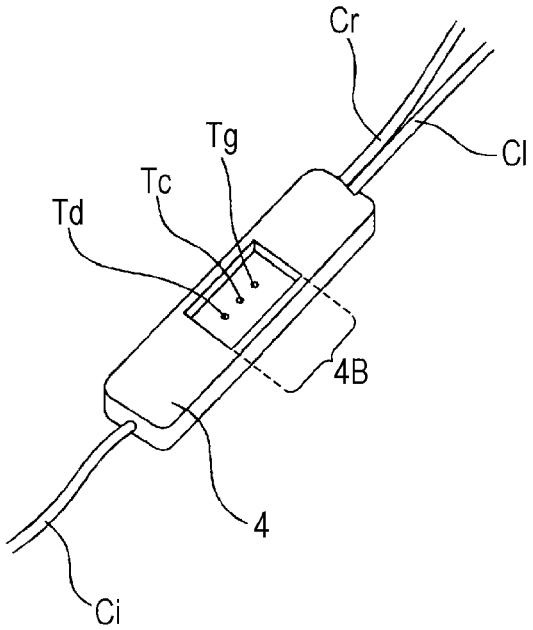
FIGS. 5A and 5B are diagrams for explaining specific modes of a communication terminal.
Figure 5B:
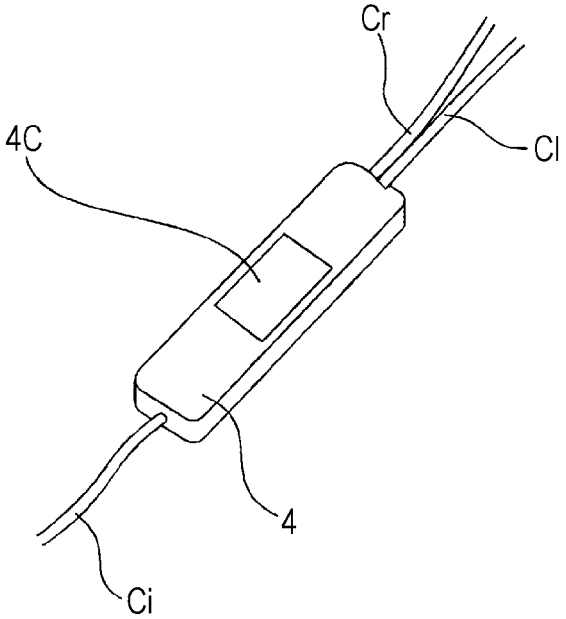

FIGS. 5A and 5B are diagrams for explaining specific modes of the communication terminal.

As illustrated in FIG. 5A, a communication terminal T is formed on a back surface, which is the opposite side of a surface on which the operation button 4A on the in-cord housing section 4 is formed (assumed to be a front surface), in an exposable manner.

Specifically, an opening section 4B is disposed on the back surface of the in-cord housing section 4, and the communication terminal T is configured in the opening section 4B so as to be exposed.

In this embodiment, as described above, the I2C method is employed as a data communication method of the microcomputer 10, and thus a data terminal Td, a clock terminal Tc, and a ground terminal Tg are formed as the communication terminal T correspondingly to this. As illustrated in FIG. 4, the data terminal Td is a terminal connected to the data line (DATA), a clock terminal Tc is a terminal connected to the clock line (CLK), and a ground terminal Tg is a terminal connected to the ground line (GND).

The above-described opening section 4B is covered with an ornament 4C as illustrated in FIG. 5B at the stage of being shipped as a product. To put it in another way, when an end user has purchased the NC earphone device 1, each of the terminals T are not exposed to the outside.

As described above, in this embodiment, in the configuration in which the microcomputers 10 for noise-canceling processing are accommodated in the housings of the sound output sections (output sections 3), the in-cord housing section 4 is provided with the communication terminal T for performing data communication with the individual microcomputers 10.

With this configuration, at the time of a sound check, it becomes unnecessary to break away a part of the housing of the sound output section in order to expose the communication terminal T, and thus it is possible to perform a sound check in the same state as that at actual use time. As a result, it is possible to suitably adjust the setting values of the noise-canceling processing.

Here, it is thought that the setting of the microcomputer 10 using the communication terminal T is performed by the user in addition to the setting at the time of factory shipment.

Figure 6:
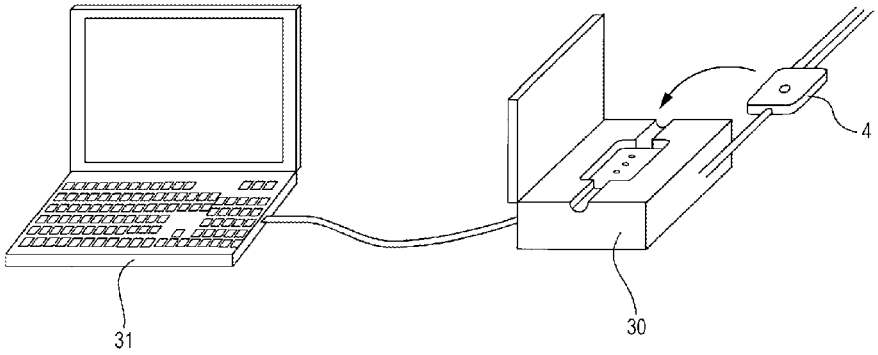
FIG. 6 is a diagram illustrating an example of a specific connection mode when a user performs various settings using the communication terminal.

When the user performs various settings, for example, as illustrated in FIG. 6, a dedicated (or may be a general) cradle 30 capable of connecting to a predetermined information processing apparatus, such as a personal computer 31, etc., is used.

Specifically, the cradle 30 in this case has a fitting section capable of fitting the in-cord housing section 4 as illustrated in FIG. 6, and the fitting section is provided with terminals that are connected to the data terminal Td, the clock terminal Tc, and the ground terminal Tg when the in-cord housing section 4 is fitted.

The user operates the personal computer 31 to which the cradle 30 is connected, and thereby the user is allowed to perform various settings in the NC earphone device 1 (the microcomputer 10) whose in-cord housing section 4 is fitted to the cradle 30.

Specific setting contents include, for example, a setting (customization) of filter characteristics of an NC filter, a setting of an optimum gain for the NC filter, etc. Alternatively, the user may be allowed to update a firmware of the microcomputer 10, or to set a frequency character of an equalizer, etc.

4. Various Functions

Here, a description will be given of various functions possessed by the Lch-side microcomputer 10*l* and the Rch-side microcomputer 10*r* in the NC earphone device 1 according to the present embodiment with reference to FIG. 7.

In this regard, in FIG. 7, the individual functions that are achieved by software processing of the Lch-side microcomputer 10*l* and the Rch-side microcomputer 10*r* are illustrated in blocks for the individual functions. In the following, for convenience, a description will be given of the various functions achieved by the software processing on the assumption that hardware (function sections Fn) is configured to achieve those functions.

In FIG. 7, the Lch-side microcomputer 10*l* includes a noise-canceling processing function section Fn1, an NC-mode determination processing function section Fn2, a remaining-amount-of-battery detection function section Fn3, a charging control section Fn4, and an external-input-setting support processing function section Fn5.

In this regard, a description will be given again of an NC-mode synchronization control function section Fn7 to a simultaneous on-control function section after checking remaining amount Fn10 later.

The noise-canceling processing function section Fn1 has been described as in FIG. 4 before. The noise-canceling processing function section Fn1 is a function section that generates the noise-canceling signal on the basis of the collected sound signal by the microphone 11*l* and the Lch signal inputted through the plug section 2, and drives the driver unit 12*l* on the basis of the noise-canceling signal in order to achieve a noise-canceling effect.

Also, the NC-mode determination processing function section Fn2 becomes a function section that determines an NC mode suitable depending on an external noise condition.

Specifically, in this embodiment, A mode: airplane, B mode: bus and train, C mode: office are determined as NC modes (NC filter characteristics). The NC-mode determination processing function section Fn2 determines a suitable mode to be set in accordance with the external noise condition on the basis of the collected sound signal by the microphone 11*l*.

Also, the remaining-amount-of-battery detection function section Fn3 detects the remaining amount of the battery 13*l*.

Also, as described in FIG. 4, the charging control section Fn4 is a function section that controls the charging operation of the charging section 141 on the battery 13*l* on the basis of a result of the determination of whether the direct current for charging is supplied through the Lch wiring line or not.

Also, the external-input-setting support processing function section Fn5 is a function section that receives setting input from the external apparatus through the above-described communication terminal T, and performs the settings in accordance with the input values. For example, if a filter coefficient of the NC filter is inputted from an external apparatus through the communication terminal T as a setting value, the external-input-setting support processing function section Fn5 performs processing for setting that coefficient as the filter coefficient of the NC filter.

On the other hand, the Rch-side microcomputer 10*r* has four function sections Fn out of the noise-canceling processing function section Fn1 to the external-input-setting support processing function section Fn5 that are possessed by the Lch-side microcomputer 10*l* by excluding the NC-mode determination processing function section Fn2.

In this regard, here, the same symbols are given to the individual function sections Fn between the Lch side and the Rch side. However, in the case of the Rch side, in the above-described description on the Lch side, the symbol of L/R is reversed as a matter of course.

Further, in accordance with the fact that the LED 15 is formed in the housing 3Rh together with the above-described four function sections Fn (Fn1, 3, 4, and 5), the Rch-side microcomputer 10*r* has the indicator display control function section Fn6.

The indicator display control function section Fn6 illustrates that the Rch-side microcomputer 10*r* has a light-emission drive control function of the LED 15 for confirmation.

Next, descriptions will be given of the NC-mode synchronization control function section Fn7, the abnormality detection and control function section Fn8, the LR simultaneous off-control function section Fn9, and the simultaneous on control after checking remaining amount Fn10, that are possessed by the Lch-side microcomputer 10*l*.

Here, processing as the NC-mode synchronization control function section Fn7 to the simultaneous on-control function section after checking remaining amount Fn10 is performed by the Lch-side microcomputer 10*l* as a master computer among the Lch-side microcomputer 10*l* and the Rch-side microcomputer 10*r*.

First, the NC-mode synchronization control function section Fn7 performs processing for synchronizing the NC mode between the Lch side and the Rch side. That is to say, the NC modes set in the Lch side and the Rch side are unified to a same NC mode determined by the NC-mode determination processing function section Fn2.

Here, if the setting states of the NC modes are different between the left and the right, the user feels sense of discomfort in listening. Accordingly, the NC-mode synchronization control function section Fn7 controls the change timing of the NC mode to synchronize between the Lch side and the Rch side (that is to say, the both sides have the simultaneous change timing).

Next, the abnormality detection and control function section Fn8 detects that an abnormality occurs in the Rch side, which is the other ch, and performs the corresponding processing in accordance with the incident.

Specifically, in this embodiment, the abnormality detection and control function section Fn8 detects that some abnormality has caused the Rch-side microcomputer 10*r* to stop the operation (that is to say, the NC processing is in an off state), and causes itself to shutdown (changes into an off state) if the operation is stopped. In this embodiment, the determination of whether the Rch side is in an operation-stopped state or not is made successively to the regular communication timing with the Rch side.

By the processing as the abnormality detection and control function section Fn8, it is possible to effectively prevent a situation in which operating states are different between the left and the right. Specifically, it is possible to effectively prevent a situation in which only the Lch side is in an on state, and thus a difference in listening sound is given the user, thereby giving a sense of discomfort to the user.

In this regard, for confirmation, in an off state of the microcomputer 10, only the noise-canceling function becomes off, and sound production based on the audio signal itself continues.

Also, the LR simultaneous off-control function section Fn9 performs processing to turn off both chs at the same time when a remaining amount of the battery of any one of the chs becomes insufficient (a predetermined amount or less), even if the other remaining amount of the battery is sufficient.

By this processing, it is possible to effectively prevent giving a sense of discomfort to the user because of a discrepancy in operation between the left and the right. That is to say, in this case, it is possible to effectively prevent a situation in which only one ch side is in an on state, and thus a difference in listening sound is given the user, thereby giving a sense of discomfort to the user.

Also, the simultaneous on-control function section after checking remaining amount Fn10 responds to a power-on instruction given by the user on the operation button 4A, and checks the remaining amounts of the battery of both the Lch side and the Rch side, and only in the case where the remaining amounts of the battery of both chs are sufficient (a predetermined amount or more), the simultaneous on-control function section after checking remaining amount Fn10 controls to start the Lch side and the Rch side at the same time.

Here, if an attempt is made to start in the case where any one of the remaining amounts of the battery for the chs is insufficient, there is a possibility that only one of the chs is started, and the other ch is not started. That is to say, a difference in listening sound might arise between the left and the right, thereby giving a sense of discomfort to the user.

Thus, only in the case where the remaining amounts of the batteries for both chs are sufficient, both of the chs are attempted to start, and thus it is possible to effectively prevent the occurrence of such a sense of discomfort.

Also, the Rch-side microcomputer 10*r* has a remaining amount display control function section Fn11.

In this embodiment, in the processing for the remaining amount display control function section Fn11, the Rch-side microcomputer 10*r* runs as a master.

The remaining amount display control function section Fn11 performs control so as to display on the LED 15 a smaller one of the remaining amounts of the batteries between the Lch side and the Rch side.

Here, in this embodiment, only one light emitting section is disposed as the LED 15, and thus it is requested for the LED 15 to display a state of the remaining amount of the battery together with an on/off state.

Thus, in this embodiment, a method of displaying these states by the LED 15 separately on the time axis is employed. Specifically, at the time of power on, the LED 15 functions as an indicator for displaying the state of the remaining amount of the battery, and after that, the LED 15 functions as an indicator for displaying the on/off state.

In conjunction with this, the remaining amount display control function section Fn11 according to this embodiment checks the remaining amount of the battery of the own ch (that is to say, Rch) side and the remaining amount of the battery of the other ch (Lch) side in response to a start of the Rch-side microcomputer 10*r*, and controls the light emission state of the LED 15 so that a display in accordance with a smaller one of the remaining amounts of the batteries is performed.

Here, in order to indicate a display mode of the remaining amount of the battery, a blinking speed, luminance of light emission, etc., can be used.

In this regard, it goes without saying that after the remaining amount of the battery is displayed as described above, the remaining amount display control function section Fn11 performs control so that the light emission state of the LED 15 displays the on state.

Here, in this embodiment, if the remaining amount of the battery of any one of the chs is insufficient, the LR simultaneous off-control function section Fn9 compulsorily turns off both of the chs even if the other ch has a sufficient remaining amount. In consideration of this point, by the remaining amount display control function section Fn11 as described above, it is understood that the remaining amount of the battery can be suitably notified to the user.

Also, as described above, in this embodiment, the LED 15 is used for displaying the remaining amount of the battery only at the time of power on. However, by this, it is possible to provide only one light emitting section in order to display the on/off state and to display the remaining amount of the battery (that is to say, can be used in common).

5. Processing Procedure

Next, descriptions will be given of specific processing procedures to be executed for performing the various functions described as the NC-mode synchronization control function section Fn7 to the remaining-amount display control function section Fn11 with reference to flowcharts from FIG. 8 to FIG. 12.

In this regard, in FIG. 8 to FIG. 12, processing denoted by "Lch" is performed on the Lch-side microcomputer 10*l*, and processing denoted by "Rch" is performed on the Rch-side microcomputer 10*r*.

Figure 8:
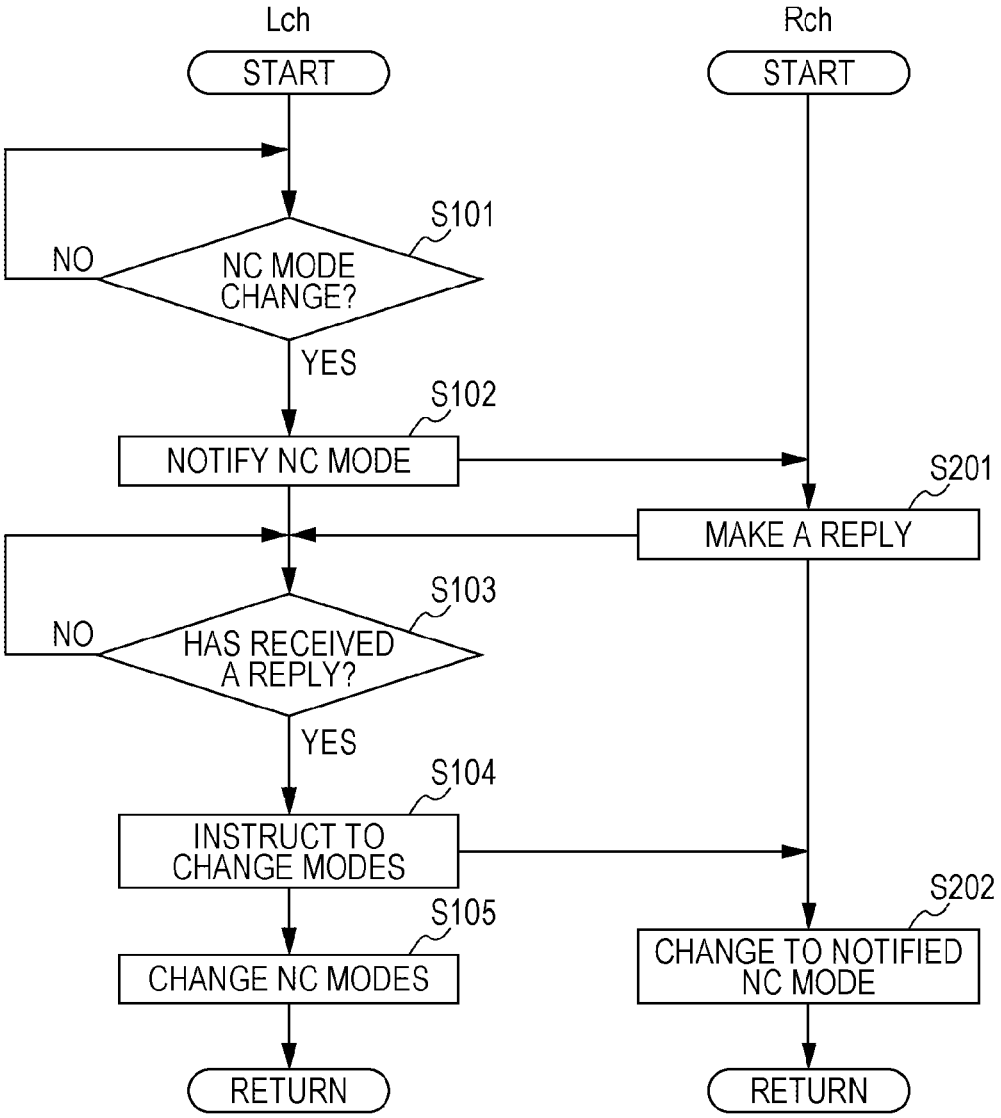
FIG. 8 is a flowchart for explaining processing operation corresponding to an NC-mode synchronization control function section.

FIG. 8 is a flowchart for explaining the processing operation corresponding to the NC-mode synchronization control function section Fn7.

First, at the Lch side, in step S101, the processing waits until the NC mode changes. That is to say, the processing waits until a new NC mode is determined by the processing as the NC-mode determination processing function section Fn2 described before.

In step S101, if determined that the NC mode has changed, in step S102, the Lch side notifies the NC mode to the Rch side. That is to say, the NC mode newly determined is notified.

In response to the notification of the NC mode, the Rch side replies to the Lch side in step S201. In this regard, this reply is a reply for confirming the reception of the above-described notification.

The Lch side waits for a reply from the Rch side in step S103.

In step S103, if a reply from the Rch side is received, the Lch side gives a mode change instruction to the Rch side in step S104.

And after that, the Lch side performs the NC mode change in step S105. That is to say, the NC mode (for example, a filter characteristic of the NC filter) is changed to a newly determined NC mode.

At the Rch side, in response to the mode change instruction in step S104, the Rch side performs processing to change to the notified NC mode in step S202. That is to say, the NC mode is changed to the NC mode notified in step S201 before.

Here, as described above, the Lch side waits for a reply from the Rch side in response to the notification of the NC mode sent by the Lch side, and then the Lch side performs the NC mode change of itself so that the NC mode change timing is synchronized.

In this regard, in the above, the NC mode settings of the left and the right are synchronized at the timing of changing the NC modes. However, for the synchronization processing of the NC modes, the Lch side (master side) may regularly notify the current NC mode to the Rch side to make a synchronization in addition.

Figure 9:
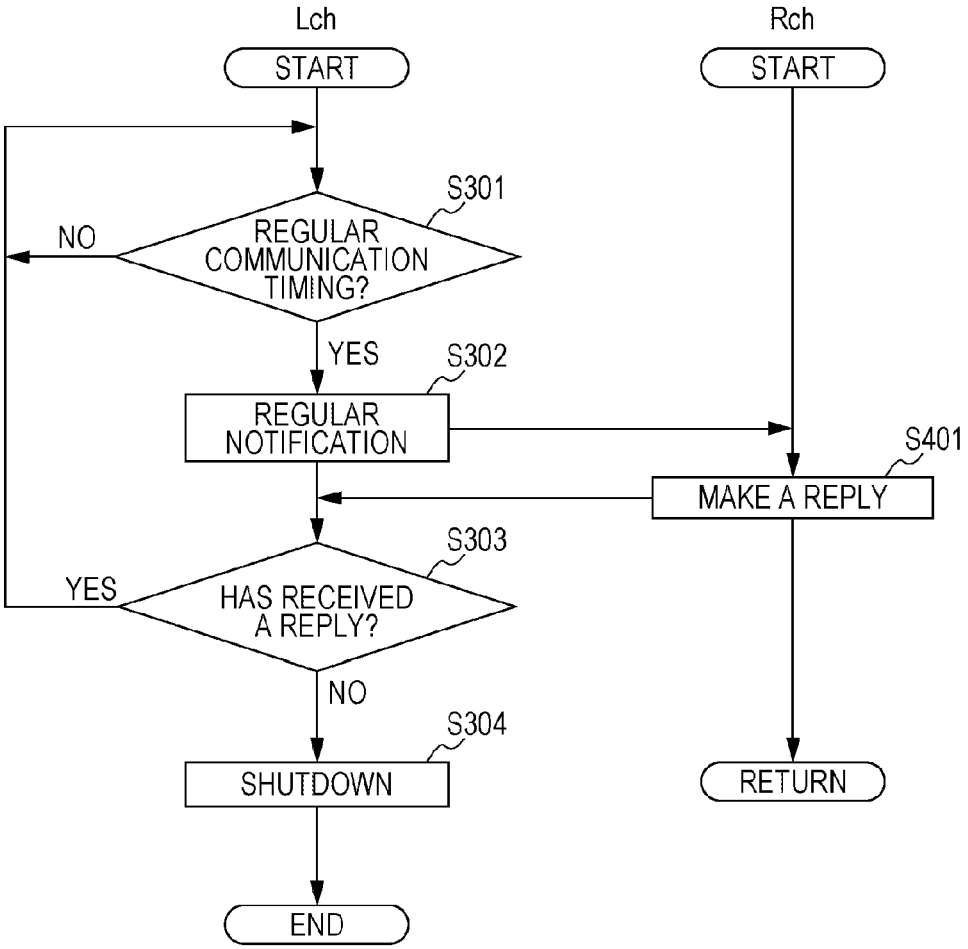
FIG. 9 is a flowchart for explaining processing operation corresponding to an abnormality detection and control function section.

FIG. 9 is a flowchart for explaining the processing operation corresponding to the abnormality detection and control function section Fn8.

In FIG. 9, the Lch side waits until the regular communication timing in step S301. That is to say, the Lch side waits until the timing comes for the regular communication with the Rch side.

And in response to arrival of the regular communication timing, the Lch side performs the regular communication with the Rch side in step S302.

In response to the regular notification, the Rch side replies to the Lch side in step S401.

In step S303, the Lch side determines whether or not a reply is made in step S401.

In step S303, if an affirmative result of the reply is obtained, the processing returns to step S301. That is to say, if a reply is obtained in this manner, the processing returns to step S301, and thus a loop processing for waiting until the detection of an operation stop state (abnormal state) of the Rch side is formed.

In step S303, if a negative result is obtained, that is to say, if there is no reply from the Rch side, the Lch side shuts down itself in step S304. Thereby, in response to the case where the Rch side is in an operation-stop state, the Lch side itself can go into the off state.

Figure 10:
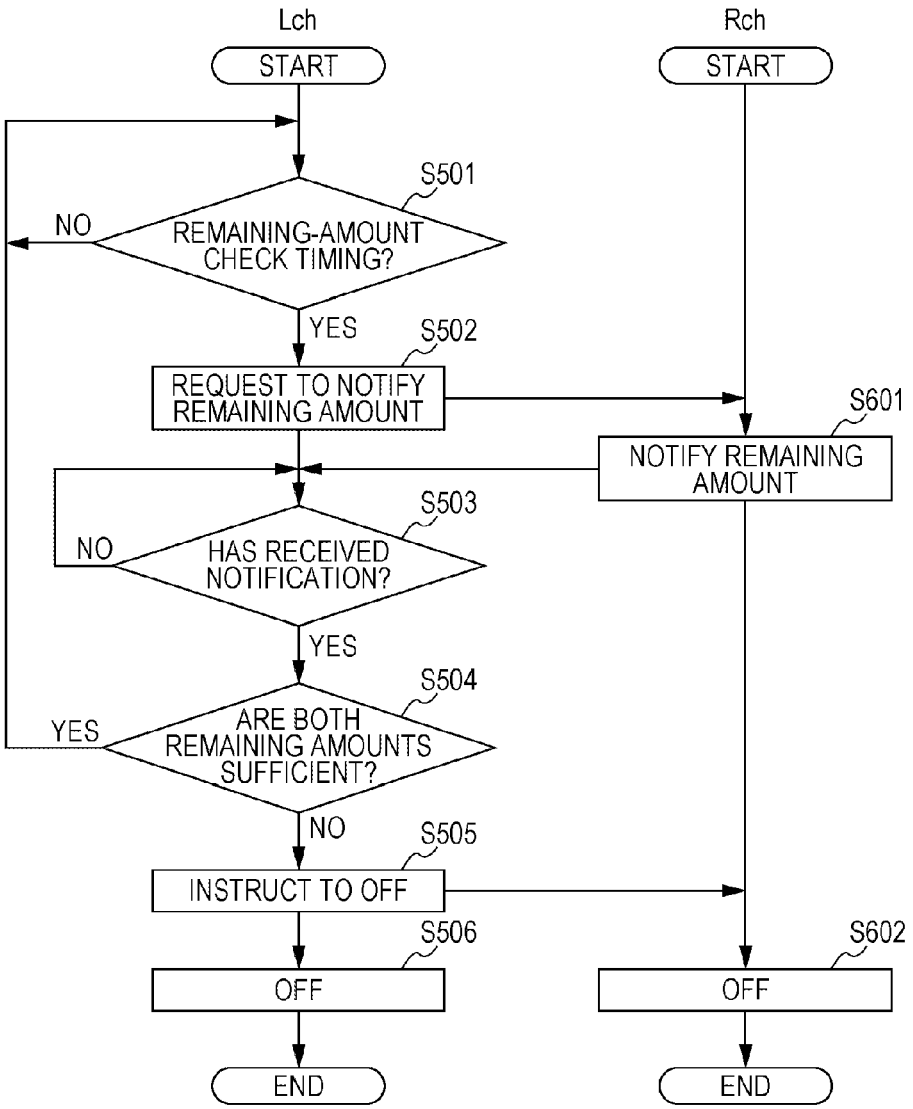
FIG. 10 is a flowchart for explaining processing operation corresponding to an LR simultaneous off-control function section.

FIG. 10 is a flowchart for explaining processing operation corresponding to the LR simultaneous off-control function section Fn9.

In FIG. 10, the Lch side waits until the remaining-amount check timing comes in step S501. The remaining-amount check timing mentioned here indicates predetermined timing that is determined at which the remaining amount of the battery should be checked in advance. For example, that timing ought to be timing of a predetermined time intervals.

In response to the remaining-amount check timing, in step S502, the Lch side makes a remaining-amount notification request to the Rch side.

In response to the remaining-amount notification request, the Rch side sends a remaining-amount notification of the battery 13*r* to the Lch side in step S601.

In step S503, the Lch side waits for the remaining-amount notification sent in step S601. And if the remaining-amount notification is received, a determination is made of whether both of the remaining amounts are sufficient or not in step S504. That is to say, a determination is made of whether or not the remaining amount of the battery 13*l*, determined by the remaining-amount-of-battery detection function section Fn3 before, and the remaining amount of the battery 13*r*, notified from the Rch side, are both sufficient, that is to say, are not less than a predetermined amount.

In step S504, if both of the remaining amounts are sufficient, and an affirmative result is obtained, the processing returns to step S501. In this manner, if the affirmative result is obtained in step S504, the processing returns to step S501 so that loop processing in which the processing waits until a negative result is obtained in step S504, that is to say, the processing waits until one of the sides does not come to meet the condition of the sufficient remaining amount is formed.

In step S504, if one of the sides does not come to meet the condition of the sufficient remaining amount, and thus a negative result is obtained, the processing proceeds to step S505, and the Lch side gives an off instruction (shutdown instruction) to the Rch side.

And after that, the Lch side goes to the off state in step S506.

The Rch side responds to the off instruction issued in step S505, and goes to the off state in step S602.

By a series of the above-described processing, if any one of remaining amounts of the batteries is insufficient, both the Lch and the Rch go to the off state at the same time.

Figure 11:
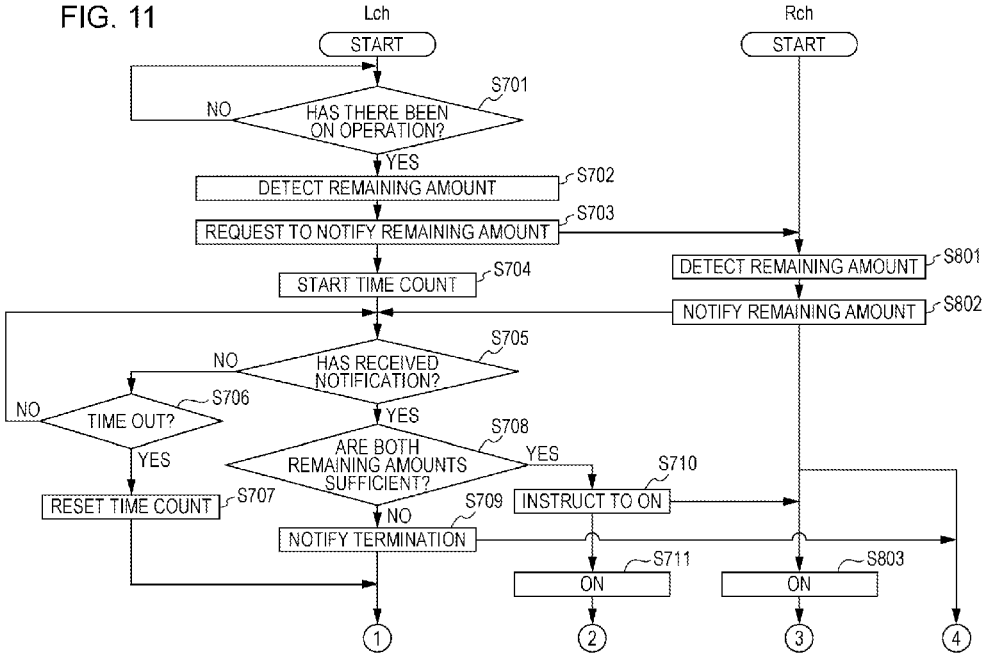
FIG. 11 is a flowchart for explaining processing operation corresponding to simultaneous on-control function section after checking remaining amount.

FIG. 11 is a flowchart for explaining processing operation corresponding to the simultaneous on-control function section after checking remaining amount Fn10. Also, FIG. 12 is a flowchart for explaining processing operation corresponding to the remaining amount display control function section Fn11.

Figure 12:
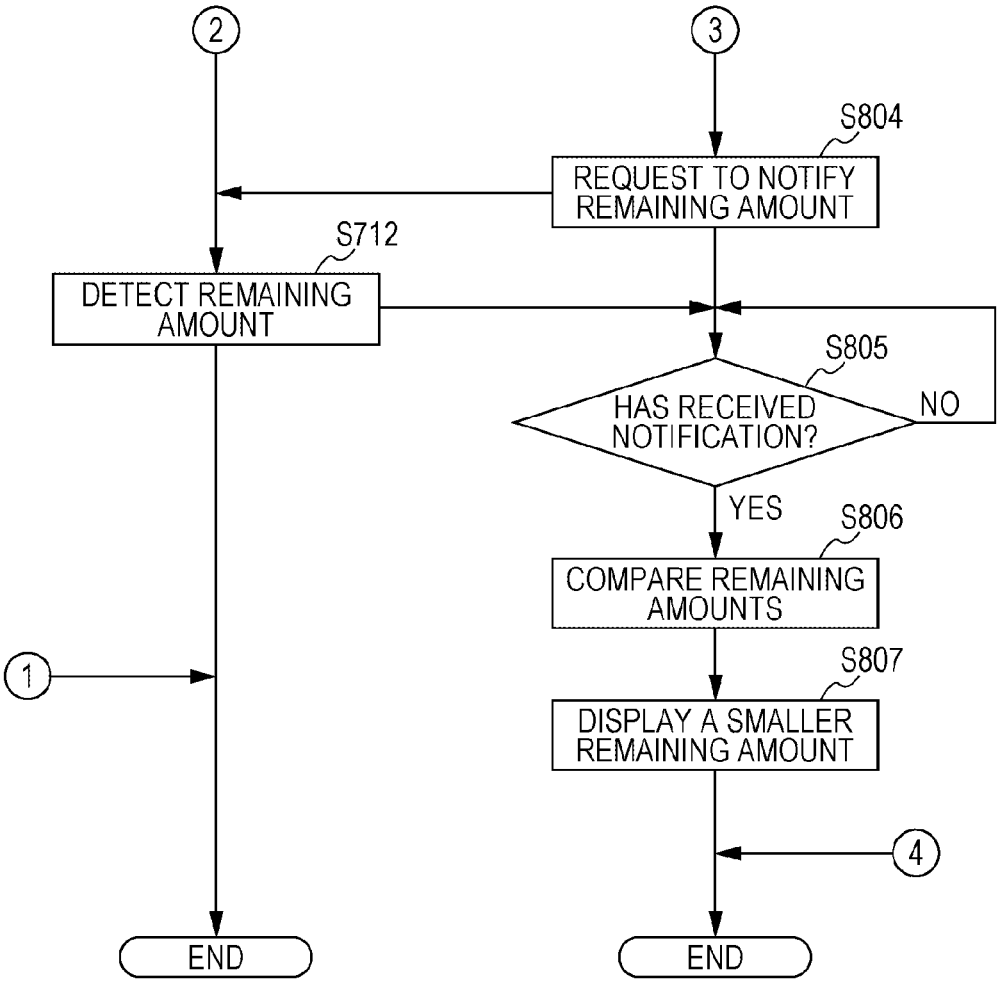
FIG. 12 is a flowchart for explaining processing operation corresponding to a remaining amount display control function section.
Figure 13:
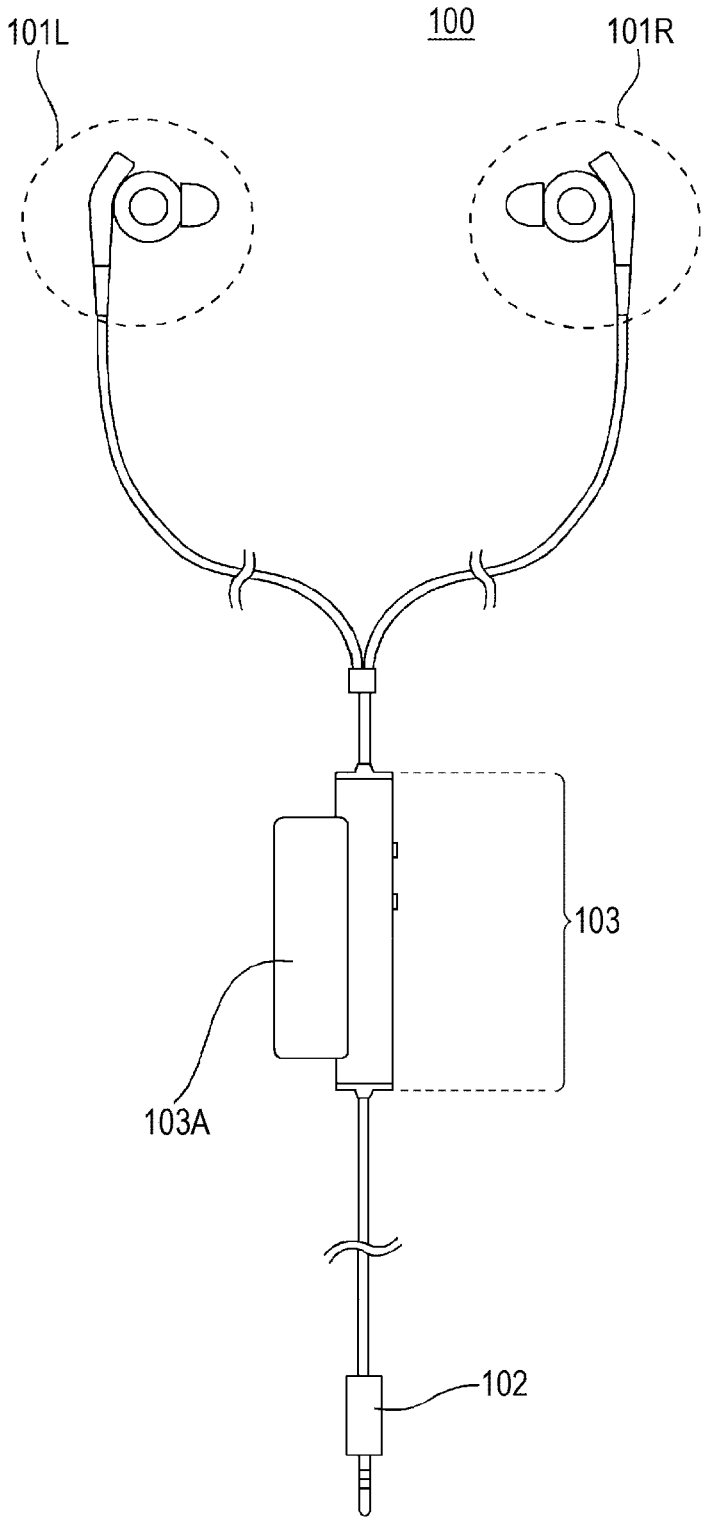
FIG. 13 is an outer view of a related-art NC earphone device.

In this regard, as is understood from the description before, in this embodiment, the processing related to the remaining amount display control function section Fn11 is performed at the time of power on, and thus processing of FIG. 12 is continued processing from the processing in FIG. 11.

First, in FIG. 11, the Lch side waits until an on operation is performed in step S701. That is to say, in this embodiment, the processing waits until pressing on the operation button 4A is detected.

If an on operation is performed in step S701, the remaining amount of the battery 13*l* is detected as the remaining amounts detection processing in step S702, and then the Lch side makes a remaining-amount notification request to the Rch side in step S703.

In response to the remaining-amount notification request made in step S703, the Rch side performs remaining-amount detection of the battery 13*r* as the remaining-amount detection processing in step S801, and then notifies the detected remaining amount to the Lch side in step S802.

Here, the Lch side makes a remaining-amount notification request in step S703, and then starts time count in step S704. The time count is carried out in order to count elapsed time from making the request in step S703.

The Lch side waits until either one of the below conditions is met after starting the time count in step S704: reception of the remaining-amount notification from the Rch side in step S705 and the occurrence of the time out in step S706.

That is to say, in step S704, the Lch side determines whether there has been a remaining-amount notification from the Rch side or not. If a negative result is obtained, which means that there has not been a remaining-amount notification from the Rch side, the processing proceeds to step S706, and whether time out or not is determined, that is to say, a determination is made of whether the time count started in S704 has reached a predetermined value or not. And if a negative result is obtained, which is not time out, in step S706, the processing returns to step S705.

Here, if the affirmative result is obtained, which means time out has occurred, in step S706, it is possible to assume that the Rch side is in some abnormal state (for example, a state in which the remaining amount of the battery 13*r* has been exhausted, and unable to reply, etc.).

Thus, if an affirmative result is obtained in step S706, the processing proceeds to step S707, the time count is reset, and the processing operation is terminated as illustrated. Thereby, it is possible to prevent a situation in which only the Lch side is started in the case where the Rch side is disabled to start, and thus the left and the right operating states can be coordinated.

On the other hand, if an affirmative result is obtained, which means that there has been a remaining-amount notification from the Rch side in step S705, the processing proceeds to step S708, and a determination is made of whether both of the remaining amounts are sufficient or not.

In step S708, if the condition that both of the remaining amounts are sufficient is not met, and thus a negative result is obtained, the processing proceeds to step S709, the Lch side sends a termination notification to the Rch side, and then the processing operation is terminated.

In response to the termination notification from the Lch side in step S709, the Rch side terminates the processing operation as illustrated.

In this manner, if the remaining amount of the battery of either one of chs is insufficient, both of the chs are caused not to start. Thereby, it is possible to effectively prevent a situation in which only one of the ch sides is started, and the other of the ch sides is not started. As a result, it is possible to prevent the occurrence of a difference in the listening sound between the left and the right, and to prevent the user from feeling a sense of discomfort.

Also, in step S708, if the affirmative result is obtained, which means that both of the remaining amounts are sufficient, the processing proceeds to step S710, the Lch side gives an on instruction (start instruction) to the Rch side, and then processing for going to an on state (that is to say, to start) is performed in step S711.

In response to the on instruction in step S710, the Rch side performs processing to go into the on state in step S803.

In this manner, only in the case where the remaining amounts of both of the chs are sufficient, both of the chs are started at the same time.

Next, a description will be given of processing illustrated in FIG. 12.

In FIG. 12, after the Rch side is started in step S803 before, the Rch side makes a remaining-amount notification request to the Lch side in step S804.

In response to the remaining-amount notification request from the Rch side, the Lch side sends a remaining-amount notification to the Rch side in step S712.

In step S805, the Rch side waits for the remaining-amount notification from the Lch side in step S712.

And if there is a remaining-amount notification from the Lch side, a comparison of the remaining amounts is made in step S806, and then the Rch side performs processing for displaying a smaller remaining amount in step S807.

That is to say, the Rch side controls the light-emission operation of the LED 15 so as to obtain a light emission state indicating the smaller remaining amount between the battery 13*l* and the battery 13*r*.

In this regard, about the display control of the remaining amount, in the above, a description has been given of the case in which the Lch side notifies the remaining amount to the Rch side, and the Rch side selects a smaller remaining amount to perform display control. However, on the contrary, it is possible for the Lch side to receive the remaining-amount notification from the Rch side, and for the Lch side to select a smaller remaining amount and to transmit a result thereof to the Rch side in order to perform remaining-amount display control.

6. Summary

As described above, in this embodiment, the battery 13 that is necessary for achieving the noise-canceling function is accommodated in both of the Lch and the Rch housings so that it becomes unnecessary to provide the in-cord housing section 103 with the battery box 103A as in the case of the related-art NC earphone device 100. Thereby, it is possible to drastically reduce the size and the weight of the in-cord housing section 4, and thereby it is possible to solve the problem in that a sense of fitting of the Lch and the Rch output sections 3 is lost because of the weight of the in-cord housing section 4.

Also, by the NC earphone device 1 according to the present embodiment, the Lch and the Rch output sections 3 have a left-right symmetrical structure, and thus it is possible to achieve an earphone device having a good balance between the left and the right weights and an excellent sense of fitting.

Also, by employing a left-right symmetrical structure, free spaces of the Lch and the Rch housings have a same volume, and thus acoustic characteristics of the left and the right become the same. As a result, it is possible to achieve a natural feeling.

Also, for a configuration in which the battery 13 is accommodated in a position other than the in-cord housing section, a configuration in which the battery 13 is accommodated in any one of the Lch and the Rch output sections 3 is considered. However, if such one-sided configuration is employed, it becomes necessary to design the housing section separately between the left and the right. In contrast, if a left-right symmetrical structure is employed, it becomes necessary to design only one channel side of the Lch and the Rch output sections 3, and to reverse that design for the other of the channel sides. Accordingly, it is possible to dramatically increase easiness in design on this point.

Also, in this embodiment, a circuit substrate 21 (microcomputer 10) is accommodated in the individual Lch and Rch output sections 3.

Accordingly, the circuit substrate 21 that performs the noise-canceling processing is accommodated in the same housing as the microphone 11. Thereby, it is possible to drastically shorten a wiring distance between the microphone 11 and the circuit substrate 21 compared with the case of disposing the circuit substrate in the in-cord housing section 103 as before.

As a result, it is possible to obtain a noise reduction effect that arises on the collected sound signal of the microphone 11.

Also, it is possible to obtain a reduction effect of unnecessary radiation that arises on the wiring lines between the microphone 11 and the circuit substrate 21.

Also, in the NC earphone device 1 according to this embodiment, if the circuit substrate 21 is formed in the in-cord housing section as before, it is necessary to extend the power-supply wiring line from the battery accommodated in the output section 3 to the in-cord housing section 4 in order to supply power to the circuit substrate 21, and thus there is a problem in that the number of wiring lines increases and the cord diameter becomes large, etc.

In contrast, by the NC earphone device 1 according to this embodiment, in which the circuit substrate 21 is accommodated in the output sections 3, it is possible to effectively prevent such a problem.

Also, in this embodiment, in the configuration in which the noise-canceling processing microcomputers 10 are accommodated in the individual housings of the sound output sections (output sections 3), respectively, the communication terminal T is disposed on the in-cord housing section 4 in order to perform data communication with the individual microcomputers 10.

With this configuration, it becomes unnecessary to break away a part of the housing of the sound output section when the communication terminal T is exposed at the time of a sound check, and thus it is possible to perform a sound check in the same state as that of actual use time. As a result, it is possible to suitably adjust the setting values of the noise-canceling processing.

Also, in this embodiment, the Lch-side microcomputer **10*l* and the Rch side microcomputer 10*r*** are configured so that data communication becomes possible between the two. Accordingly, it is possible for one of the Lch side and the Rch side to easily grasp the operating state of the other of the two sides.

Thereby, it is possible to effectively prevent the occurrence of the problem in that the Lch side and the Rch side do not mutually grasp each other's operating state, and the left-side and right-side operations do not match. Accordingly, it is possible to coordinate operations between both of the channels.

As a result, it is possible to effectively prevent the occurrence of the situation in which the user feels a sense of discomfort because of the difference in the operation of the Lch side and the Rch side.

7. Variations

As described above, the description has been given of the embodiment according to this technique. However, this technique should not be limited to the specific example described so far.

For example, in the description so far, an example of the case in which the batteries 13 are accommodated in the Lch and the Rch output sections 3 has been given. However, in this technique, it is also possible to accommodate the battery 13 in the in-cord housing section.

Also, it is possible to apply this technique not only to an earphone device, but also to suitably apply to a headphone device of an overhead-type, etc., for example.

Also, it is possible to apply this technique not only to an FF method as a noise canceling method, but also to suitably apply to the case of employing an FB method. In particular, in the case of an overhead-type headphone device, it is possible to suitably apply the FB method. In this regard, in the case of the FB method, the microphone 11 is installed at a position that allows collecting sound that arises in a space between an ear of the user and the device (both of the sound generated by the driver unit and external noise sound leaking into the ear of the user).

Also, it is possible to configure this technique as follows.

(1) A sound reproducing device including:

a plug section configured to receive input of an L-channel audio signal and an R-channel audio signal;

an L-channel housing section including at least an L-channel driver unit configured to produce L-channel sound on the basis of the L-channel audio signal, an L-channel microphone configured to collect external sound, and an L-channel microcomputer configured to perform setting control on noise-canceling processing on the basis of a collected sound signal of the L-channel microphone;

an R-channel housing section including at least an R-channel driver unit configured to produce R-channel sound on the basis of the R-channel audio signal, an R-channel microphone configured to collect external sound, and an R-channel microcomputer configured to perform setting control on noise-canceling processing on the basis of a collected sound signal of the R-channel microphone; and an in-cord housing section formed so as to be inserted in a wiring cord for supplying the signals inputted from the plug section to the L-channel housing section and the R-channel housing section, wherein the in-cord housing section is provided with a communication terminal for allowing data communication between the L-channel microcomputer and the R-channel microcomputer, and an external apparatus.

(2) The sound reproducing device according to (1), wherein the L-channel housing section and the R-channel housing section individually contain a battery.

It should be understood by those skilled in the art that various modifications, combinations, sub-combinations and alterations may occur depending on design requirements and other factors insofar as they are within the scope of the appended claims or the equivalents thereof.

What is claimed is:

1. A sound reproducing device comprising:

a plug section configured to receive input of an L-channel audio signal and an R-channel audio signal;

an L-channel housing section including at least an L-channel driver unit configured to produce L-channel sound on the basis of the L-channel audio signal, an L-channel microphone configured to collect external sound, and an L-channel microcomputer configured to perform setting control on noise-canceling processing on the basis of a collected sound signal of the L-channel microphone;

an R-channel housing section including at least an R-channel driver unit configured to produce R-channel sound on the basis of the R-channel audio signal, an R-channel microphone configured to collect external sound, and an R-channel microcomputer configured to perform setting control on noise-canceling processing on the basis of a collected sound signal of the R-channel microphone; and an in-cord housing section formed so as to be inserted in a wiring cord for supplying the signals inputted from the plug section to the L-channel housing section and the R-channel housing section, wherein the in-cord housing section is provided with a communication terminal for allowing data communication between the L-channel microcomputer and the R-channel microcomputer, and an external apparatus.

2. The sound reproducing device according to claim 1, wherein the L-channel housing section and the R-channel housing section individually contain a battery.

* * * * *